US011761355B2

(12) United States Patent
Noble

(10) Patent No.: US 11,761,355 B2
(45) Date of Patent: Sep. 19, 2023

(54) VAPOR-POWERED LIQUID-DRIVEN TURBINE

(71) Applicant: Linden Noble, Guelph (CA)

(72) Inventor: Linden Noble, Guelph (CA)

( * ) Notice: Subject to any disclaimer, the term of this patent is extended or adjusted under 35 U.S.C. 154(b) by 0 days.

(21) Appl. No.: 17/934,412

(22) Filed: Sep. 22, 2022

(65) Prior Publication Data

US 2023/0102894 A1 Mar. 30, 2023

Related U.S. Application Data

(60) Provisional application No. 63/250,139, filed on Sep. 29, 2021.

(51) Int. Cl.

| | |
|---|---|
| ***F01K 25/02*** | (2006.01) |
| ***F01K 7/16*** | (2006.01) |
| ***F01K 3/00*** | (2006.01) |

(52) U.S. Cl.
CPC ..... *F01K 25/02* (2013.01); *F01K 3/004* (2013.01); *F01K 7/16* (2013.01)

(58) Field of Classification Search
CPC ..... F01K 25/02; F01K 3/004; F01K 7/16
See application file for complete search history.

(56) References Cited

U.S. PATENT DOCUMENTS

| | | | | |
|---|---|---|---|---|
| 9,382,816 | B2 * | 7/2016 | Almbauer | F01K 25/10 |
| 10,598,052 | B2 * | 3/2020 | Ebert | F01K 27/005 |
| 2011/0000205 | A1 * | 1/2011 | Hauer | F01K 25/065 60/511 |
| 2011/0265476 | A1 * | 11/2011 | Berger | F01K 13/02 60/671 |
| 2015/0354398 | A1 * | 12/2015 | Rutten | F03G 6/065 60/641.15 |
| 2021/0032129 | A1 * | 2/2021 | Ramamurthy | B01D 61/12 |

OTHER PUBLICATIONS

George Kosmadakis, et al; Experimental testing of a low-temperature organic Rankine cycle (ORC) Engine coupled with concentrating PV / thermal collectors: Laboratory and field tests; Energy 117 (2016) pp. 222-236.

* cited by examiner

*Primary Examiner* — Shafiq Mian
(74) *Attorney, Agent, or Firm* — Damien G. Loveland

(57) ABSTRACT

Traditional power generation with a turbine may be inefficient, costly or inconvenient. The improvement disclosed herein involves the use of two fluids. A pressurizing fluid is vaporized, pressurized and fed into a pressure cylinder holding a liquid working fluid. The pressurizing fluid forces the working fluid out of the pressure cylinder and through a liquid turbine to generate electricity or perform work. The working fluid is recycled from the turbine into another pressure cylinder for re-use. The pressurizing fluid is condensed and then also recycled back to the evaporator where it is vaporized and pressurized again. Use of a liquid rather than gas turbine makes for improved efficiency and lower cost. The use of a separate pressurizing fluid, which may be volatile, allows for convenient use where the temperature of the thermal source is limited.

74 Claims, 5 Drawing Sheets

VAPOR-POWERED LIQUID-DRIVEN TURBINE

TECHNICAL FIELD

This application relates to power generation using turbines. More specifically, it relates to the use of liquid turbines.

BACKGROUND

Early steam engines created electricity by using steam to drive pistons. This was effective technology at the time, however their efficiency and scalability was limited in part by how large a physical piston could be, due to manufacturing difficulties.

A Rankine cycle typically generates power by passing water through an evaporator, creating steam. The steam drives a gas turbine, which in turn generates electricity. The vapor is then condensed and recycled through the evaporator. Many different configurations may be used to increase the efficiency of this process, for example through the use of preheaters and pressure differentials. Efficiency can also be boosted through the use of a second turbine, so that one operates at low pressure and another one at high pressure. This method is an effective form of power generation in scenarios where sufficient quantities of thermal energy are available to boil water and create a large pressure differential. These processes are generally only feasible at large scales due to the complexity of the gas turbines.

FIG. 1 shows a prior art Rankine cycle. The evaporator 10 creates a vapor by boiling water. The vapor is then directed to a gas turbine 12 to generate electricity. The vapor then passes into a condenser 14, where it is condensed. Finally, the condensed water is fed by a liquid pump 16 back into the evaporator 10, and the cycle carries on in a continuous loop.

A variation of the Rankine cycle, known as an organic Rankine cycle, uses organic fluids such as butane or propane as the fluid that is evaporated. This is effective because these fluids typically have much lower boiling points than water, allowing for vapor to be produced with a much lower temperature. This allows for them to be used in a wider array of applications, where thermal energy is available but at a lower temperature. In these installations, however, the available temperature differential is not great enough to generate a large enough pressure differential for an efficient transmission of kinetic energy. The organic Rankine cycle has the same drawbacks as a steam based Rankine cycle as relates to efficiency and capital cost. The most efficient ORC systems can only achieve a maximum efficiency of 4-6% at temperatures below 100 C (Kosmadakis et al., Experimental testing of a low-temperature organic Rankine cycle (ORC) engine coupled with concentrating PV/thermal collectors: Laboratory and field tests. Energy, Elsevier, 2016, 117, pp. 222-236).

Liquid turbines are commonly used in power generation with great success. The most common example of this is in hydroelectric dams, where the flow of water drives the turbines, transferring the kinetic energy of the water into electricity. This is an effective method of power generation but it relies on a source of flowing water to create electricity, greatly limiting its applications.

This background is not intended, nor should be construed, to constitute prior art against the present invention.

SUMMARY OF INVENTION

The vapor-powered liquid-driven turbine system disclosed herein utilizes many of the same components found in a typical gas turbine application. An evaporator vaporizes the pressurizing fluid to create a pressure differential, a condenser catches the vapor, condenses it and allows the pressurizing fluid to be recycled, and preheaters and pressure stages can be used to boost the overall system efficiency.

An improvement comes from the use of two or more fluid columns between the evaporator and the liquid turbine. Vapor is injected into a pressure cylinder filled with working fluid, causing the pressure cylinder to pressurize and push the working fluid out, through a liquid turbine and into another pressure cylinder. The working fluid that has passed through the liquid turbine fills the other pressure cylinder, priming the system for another "stroke" through the liquid turbine. The working fluid alternately refills and empties from each pressure cylinder in the system, and is repeatedly pushed through the liquid turbine by the incoming, pressurized vapor. The addition of more pressure cylinders allows for smoother operation, as these extra pressure cylinders can pressurize while other ones are completing their strokes. A pressure-sustaining device may be employed in order to ensure complete strokes are performed at the appropriate pressure and to ensure that the flow of the working fluid through the liquid turbine is as constant as possible.

An advantage of some embodiments of the system is the possibility to use more affordable, efficient, and effective turbines, designed for liquids instead of gases. This allows for more efficient power generation in remote locations where it has previously been difficult to generate power, and at temperatures that are currently not useful for producing electricity. The technology disclosed may also be used in places that are already suitable for power generation via one of the other methods, e.g. Rankine cycle, and may provide a more affordable and more efficient alternative. The system provides an improvement of one or more of the efficiency, versatility, scalability, and affordability of power generation using thermal energy to drive liquid turbines.

Disclosed is a power generation system comprising: an evaporator; a condenser; a liquid pump connected to pump pressurizing fluid, in a liquid state, from the condenser to the evaporator; a liquid turbine; multiple pressure cylinders, each with an inlet from the evaporator, an outlet to the condenser, an outlet to the liquid turbine and an inlet from the liquid turbine; and multiple valves that are operable to (a) admit a volume of the pressurizing fluid, when gaseous, from the evaporator, into a first one of the pressure cylinders in order to transfer a liquid working fluid therefrom to the liquid turbine and (b) admit the liquid working fluid from the liquid turbine into a second one of the pressurizing cylinders in order to transfer another volume of the pressurizing fluid therefrom to the condenser.

Also disclosed is a method for driving a liquid turbine comprising: (a) using a liquid pump to pump a pressurizing fluid, in a liquid state, from a condenser to an evaporator; (b) evaporating the pressurizing fluid using the evaporator; (c) admitting a volume of the pressurizing fluid from the evaporator into a first pressure cylinder in order to transfer a liquid working fluid therefrom to a liquid turbine; and (d) admitting the liquid working fluid from the liquid turbine into a second pressure cylinder in order to transfer another volume of the pressurizing fluid therefrom to the condenser.

This summary provides a simplified, non-exhaustive introduction to some aspects of the invention, without delineating the scope of the invention.

BRIEF DESCRIPTION OF DRAWINGS

The following drawings illustrate embodiments of the invention and should not be construed as restricting the scope of the invention in any way.

DESCRIPTION

Glossary

Condenser: Any device or group of devices that can convert a fluid in its gaseous state to its liquid state. A condenser may be a device or a part of a device that performs another function, or it may be made of multiple constituent devices.

Evaporator: Any device or group of devices that convert a fluid from its liquid state to its gaseous state. An evaporator may be a device or a part of a device that performs another function, or it may be made of multiple constituent devices.

Pressurizing fluid: This is the fluid that is boiled in order to create the pressure in the system. This fluid is boiled by the evaporator and cooled or condensed through performing work, by forcing the working fluid out of the vessels. The pressurizing fluid may be any liquid that boils. Functionally, the boiling point of the pressurized fluid must be below that of the boiling point of the working fluid. Examples of the pressurizing fluid are hexane, pentane and butane. In some embodiments, the pressurizing fluid may be water/steam in systems where the working fluid has a higher boiling point than water. It is an advantage for the pressurizing fluid and the working fluid to be immiscible. In some embodiments, the boiling points of the pressurized fluid and the working fluid may be equal, provided the working fluid is adequately cooled to prevent it from exceeding its boiling point. An example of this would be using steam to pressurize water as the working fluid.

Working fluid: This is the fluid that is forced out of the pressure cylinder and through the liquid turbine, transferring the potential energy of the gaseous pressurizing fluid into the kinetic energy of the working fluid and in turn into electrical energy via the liquid turbine. The working fluid is typically water or any other liquid with a boiling point higher than the boiling point of the pressurizing fluid. However, the working fluid may be an oil, such as canola oil or a synthetic oil, or a dense fluid such as mercury.

Pressure cylinder: This is a vessel or tank used to transfer the potential energy of the gaseous pressurizing fluid into kinetic energy of the working fluid. The gaseous pressurizing fluid enters the top of the pressure cylinder and increases the head pressure in the pressure cylinder. Since there is a lower pressure zone after the liquid turbine, the working fluid rapidly exits the base of the pressure cylinder and into the liquid turbine, converting the kinetic energy of the working fluid into electrical energy as the turbine rotates.

System: When used herein, unless otherwise qualified, this refers to an example of a vapor-powered, liquid-driven turbine system.

Superheating: This refers to heating a vapor above its condensation temperature.

EXEMPLARY EMBODIMENTS

Figure 1:
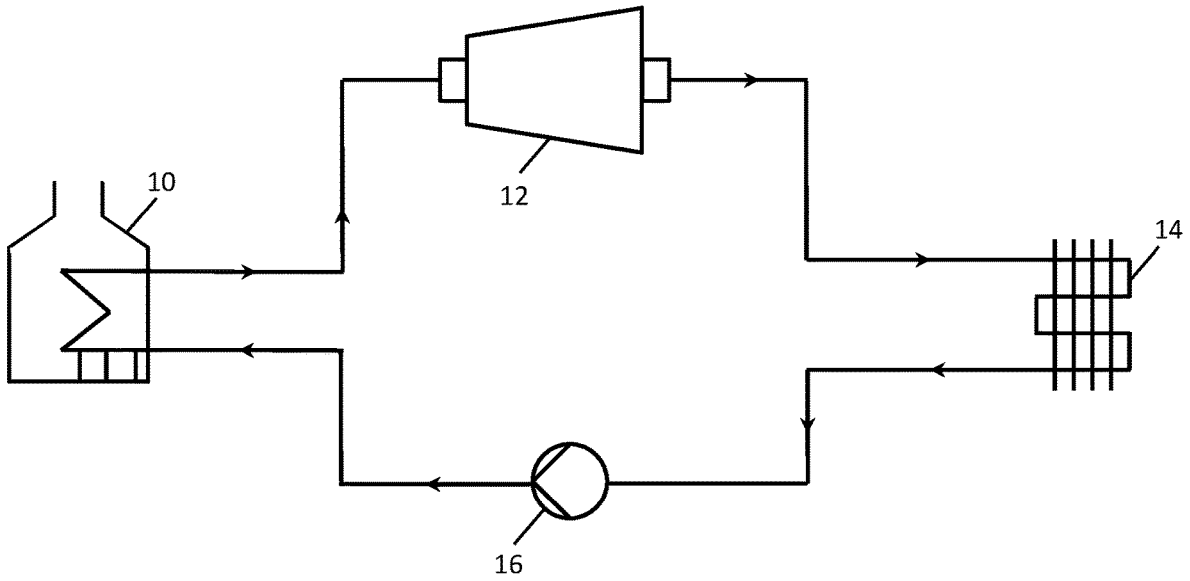
FIG. 1 (PRIOR ART)
FIG. 1 is a prior art Rankine cycle.
Figure 2:
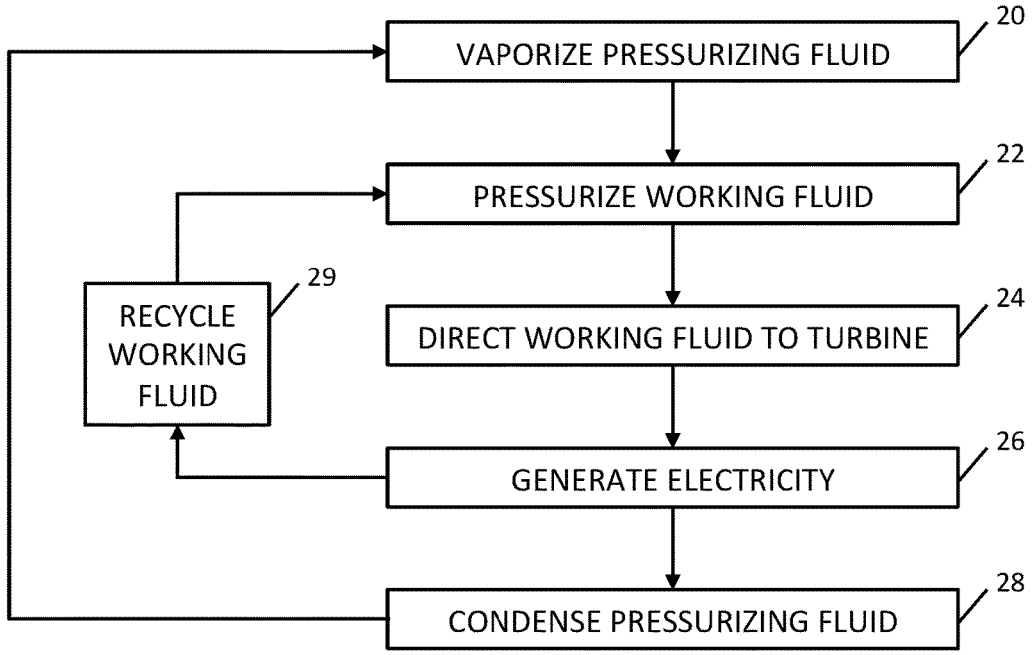
FIG. 2 is a flowchart of the system operation, according to an embodiment of the present invention.

Referring to FIG. 2, the process the system undergoes is shown in a flowchart. In step 20, the pressurizing fluid is vaporized. In step 22, the resulting vapor is used to pressurize the working fluid. In step 24, the working fluid, which is a liquid, is directed to a liquid turbine. In step 26, the liquid turbine generates electricity. In step 28, the pressurizing fluid is condensed, and in a continuous loop the process reverts to step 20, in which the pressurizing fluid is once again vaporized. In step 29, the working fluid that has passed through the liquid turbine is recycled in order to be driven again through the liquid turbine.

Figure 3:
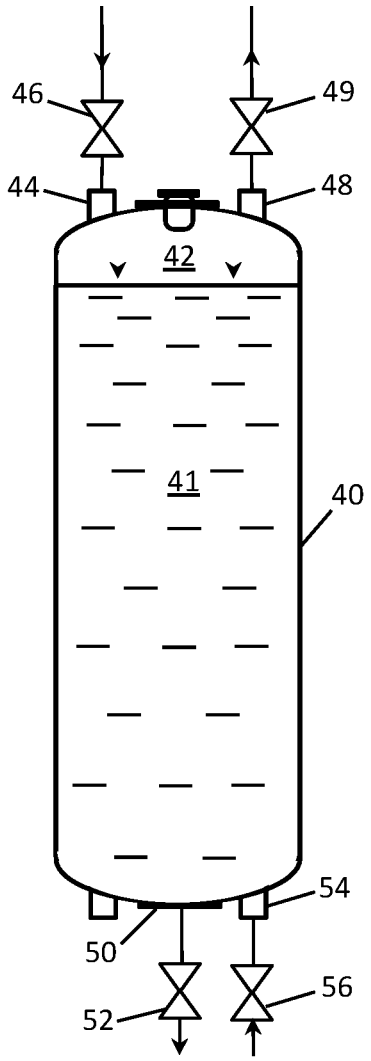
FIG. 3 is an example of a pressure cylinder that may be used in the system, according to an embodiment of the present invention.

Referring to FIG. 3, an example of a vessel that may be used as a pressure cylinder is shown. The pressure cylinder has a chamber 40, shown holding working fluid 41, which is a liquid, and pressurizing fluid 42, which enters the top of the vessel as a gas. Depending on the state of the cycle, the pressurizing fluid may be all vapor or partially condensed. At the top of the chamber, an inlet 44 allows the pressurizing fluid 42 to enter the chamber 40 from the evaporator, via valve 46, and an outlet 48 allows the pressurizing fluid to exit from the chamber to go to the condenser, via valve 49. At the bottom of the chamber 40 an outlet 50 allows working fluid 41 to leave the chamber, via valve 52, to drive the liquid turbine. An inlet 54 allows working fluid to re-enter the chamber 40 from the liquid turbine via valve 56. As shown here by the arrowheads, the pressurizing fluid 42 is forcing the working fluid 41 down to expel it from the chamber 40.

Figure 4:
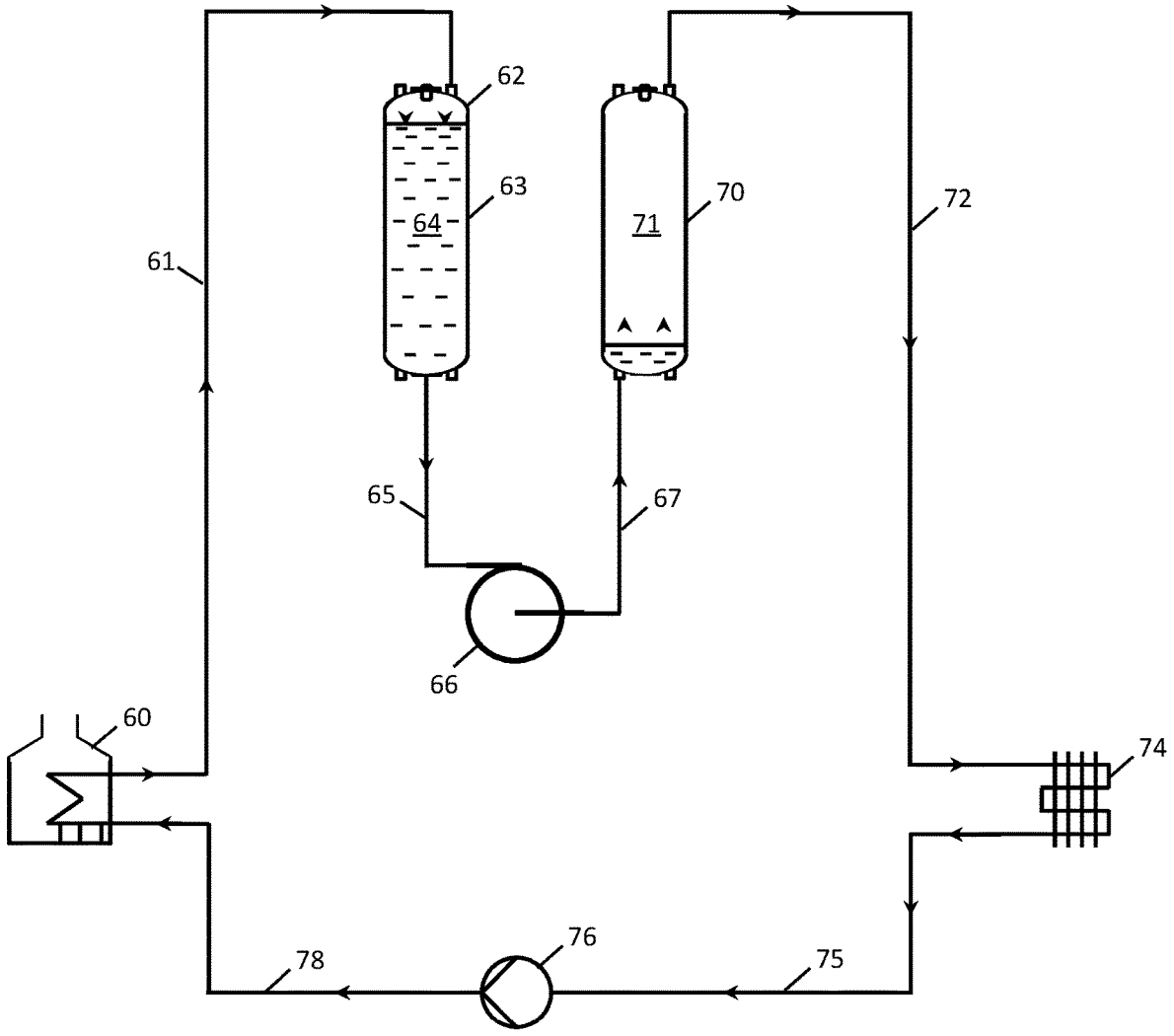
FIG. 4 demonstrates the principle of operation of the system, according to an embodiment of the present invention.

A principle of operation of one stage of the system is shown in FIG. 4. An evaporator 60 or boiler turns the incoming pressurizing fluid into vapor, which passes along a fluid transfer line 61 to be injected into the top area 62 of a pressure cylinder 63 filled with liquid working fluid 64. This causes the pressure cylinder 63 to pressurize and push the working fluid 64 out along line 65 to a water or other liquid turbine 66. As shown here by the arrowheads, the working fluid 64 is moving down. The working fluid then passes via transfer line 67 into an adjacent pressure cylinder 70. As the pressure cylinder 70 fills with the working fluid as shown by the arrowheads, another volume of pressurizing fluid 71 above it is expelled from the pressure cylinder 70 along transfer line 72 to condenser 74. The resulting, condensed pressurizing fluid is then directed via transfer line 75 to liquid pump 76, which pumps it along transfer line 78 back to the evaporator 60. Other components not shown here, such as additional valves, transfer lines and connections may be added so that the working fluid can be repeatedly transferred back and forth between the pressure cylinders, and so that the pressurizing gas can be alternately transferred from each pressure cylinder to the condenser, repeatedly.

Figure 5:
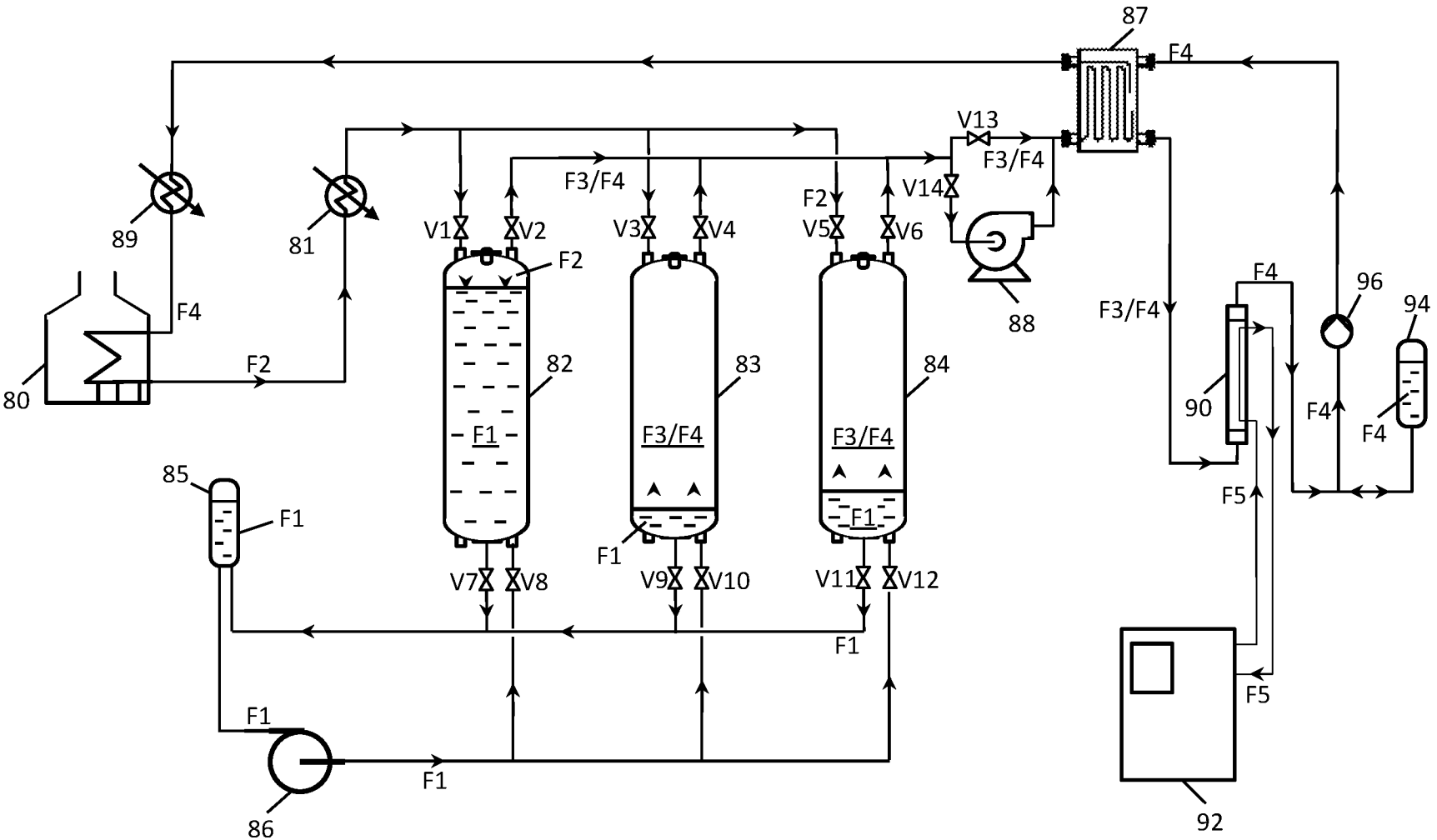
FIG. 5 is a system with three pressure cylinders and a single turbine, according to an embodiment of the present invention.

Referring to FIG. 5, an exemplary system with three pressure cylinders is shown. The working fluid is denoted F1, which is the liquid that is forced out of the pressure cylinders 82, 83, 84 and through the liquid turbine 86. The working fluid is typically water or any liquid with a boiling point higher than the boiling point of the pressurizing fluid. The pressurizing fluid in its gaseous state is denoted F2, which is the hot gaseous pressurizing fluid produced by the evaporator 80 to create the pressure in the system. As the pressurizing fluid works its way around the system, it cools and becomes less pressurized and perhaps partially condensed. In the cooled state, the pressurizing fluid is denoted F3. When the pressurizing fluid is fully condensed it is denoted F4. When partially condensed, the pressurizing fluid is denoted F3/F4.

Starting from the evaporator 80 or boiler, incoming condensed pressurizing fluid F4 is boiled. The resulting hot gaseous pressurizing fluid F2 is then fed to an inline heater 81, which superheats the gaseous pressurizing fluid before it enters the pressure cylinders 82, 83, 84 via valves V1, V3, V5. The pressurizing fluid is in its hottest state immediately after superheating. This hot gaseous pressurizing fluid F2 performs work by forcing the working fluid out F1 of the pressure cylinders 82, 83, 84. Depending on which of the pressure cylinders 82, 83, 84 is primed with working fluid F1, its respective valve V7, V9 or V11 is opened to allow the working fluid F1 to be directed via a buffer tank 85 to the liquid turbine 86. The buffer tank has a defined head pressure and evens out the pressure and flow rate of the working fluid F1 during the pressure cycles within the pressure cylinders, so that the liquid turbine 86 runs at a consistent speed. This allows for smoother operation of the system. The potential energy of the pressurizing fluid F2 is converted into kinetic energy of the working fluid F1 and then into electrical energy via the liquid turbine 86, as the liquid turbine is coupled to an electrical generator. The liquid turbine may be, for example, a centrifugal pump operated in reverse in some embodiments. On exiting the liquid turbine 86, the working fluid F1 returns to one of the pressure cylinders 82, 83, 84 via inlet valve V8, V10 or V12 respectively.

As the pressure cylinder 82, 83 or 84 refills with working fluid F1, the pressurizing fluid F3/F4 in the pressure cylinder, now cooler and potentially partially condensed, is expelled through valve V2, V4 or V6 respectively in the top of the pressure cylinder. The pressurizing fluid F3/F4 is, in one operating configuration, fed via valve V13 to a regenerator 87. The regenerator 87 takes heat from the condensation side of the gaseous pressurizing fluid loop and returns it to the boiler side of the pressurizing fluid loop. This may improve the efficiency of the system by reducing the amount of heat that needs to be added via the evaporator 80.

In another operating configuration of the system, the expelled pressurizing fluid F3/F4 is directed through valve V14 to an MVR (mechanical vapor recompression) blower 88 or compressor and then to the regenerator 87. The MVR blower 88 is used to compress the gaseous pressurizing fluid such that more thermal energy can be recovered in the regenerator 87. In some embodiments it is possible to volatilize the liquid pressurizing fluid F4 in the regenerator 87 on its way back to the evaporator 80 by increasing the pressure of the gaseous pressurizing fluid coming from the pressure cylinders 82, 83, 84. This may improve the efficiency of the system because the heat of vaporization can be recovered and the heating requirement of the boiler can be reduced.

After the pressurizing fluid F3/F4 from the pressure cylinders 82, 83, 84 leaves the regenerator 87, a condenser 90 recondenses the gaseous pressurizing fluid into a liquid F4 and rejects the heat of condensation. A chiller 92 removes the heat of condensation from the pressurizing fluid F3/F4. The chiller 92 uses fluid F5, which is a heat transfer fluid, to take thermal energy away from the condenser 90 and reject it through the chiller.

After exiting the condenser 90, the now liquid pressurizing fluid F4 passes to a liquid pump 96, which pressurizes the liquid pressurizing fluid F4 and sends it back through the regenerator 87 and into the evaporator 80. Another buffer tank 94 holds a volume of liquid pressurizing fluid F4 so that the liquid pump 96 is never starved of liquid.

On its way back to the evaporator 80, the pressurizing fluid F4 passes through an inline heater 89, which heats the liquid pressurizing fluid before it returns to the evaporator. If the pressurizing fluid is evaporated in the regenerator, the evaporator will impart more heat to the gaseous pressurizing fluid.

As shown, pressure cylinder 82 is being or is about to be pressurized with the gaseous pressurizing fluid F2 such that the working fluid F1 is forced out of the bottom of the pressure cylinder. The gaseous pressurizing fluid F2 partially condenses to F3/F4 as it expands into the pressure cylinder and transfers its gas pressure energy into the kinetic energy of the working fluid F1. Pressure cylinder 83 is used for receiving the outlet flow from the liquid turbine 86 when it is open to the condenser 90. While pressure cylinder 82 is emptying, pressure cylinder 83 is filling. Pressure cylinder 83 is also used for another pressure cycle when it is open to the evaporator 80. Pressure cylinder 84 is used for receiving the outlet flow from the liquid turbine 86 when pressure cylinder 84 is open to the condenser 90. Pressure cylinder 84 is also used for another pressure cycle when it is open to the evaporator 80. Each of the pressure cylinders 82, 83, 84 is used in the same way in a cyclic fashion. Valves are operated such that the system operates continuously. Pressure cylinders 82, 83, 84 may also be used as buffer tanks to smooth flow and pressure in the system.

In operation, pressure cylinder 82 empties its working fluid F1 into pressure cylinder 83, which then empties into pressure cylinder 84. Pressure cylinder 84 then empties the working fluid into pressure cylinder 82. The pressure cylinder that is not involved in a particular transfer of working fluid remains inactive, and is open to the condenser 90 between cycles. TABLE 1 shows trigger points for operating the various valves that connect to the pressure cylinders 82, 83, 84. When the trigger points occur, the valves are either set to open (1) or closed (0). Valves V1, V3, V5 connect the headspace of the pressure cylinders 82, 83, 84 to the evaporator 80, for pressurizing the pressure cylinders. Valves V2, V4, V6 connect the headspace of the pressure cylinders to the condenser 90 for expelling the pressurizing fluid and depressurizing the pressure cylinders. Valves V7, V9 and V11 connect the bottoms of the pressure cylinders to the inlet side of the liquid turbine 86. Valves V8, V10 and V12 connect the pressure cylinders to the outlet side of the liquid turbine 86 so that the working fluid can be returned to the pressure cylinders.

TABLE 1

| | Valve, connection | Step 1 | Step 2 | Step 3 |
|---|---|---|---|---|
| Pressure cylinder 82 | V1, evaporator | 1 | 0 | 0 |
| | V2, condenser | 0 | 1 | 1 |
| | V7, turbine | 1 | 0 | 0 |
| | V8, return | 0 | 0 | 1 |
| Pressure cylinder 83 | V3, evaporator | 0 | 1 | 0 |
| | V4, condenser | 1 | 0 | 1 |
| | V9, turbine | 0 | 1 | 0 |
| | V10, return | 1 | 0 | 0 |
| Pressure cylinder 84 | V5, evaporator | 0 | 0 | 1 |
| | V6, condenser | 1 | 1 | 0 |
| | V11, turbine | 0 | 0 | 1 |
| | V12, return | 0 | 1 | 0 |
| Trigger for next step | | Cylinder 82 F1 low | Cylinder 83 F1 low | Cylinder 84 F1 low |

Regarding the first step in TABLE 1, this starts when the pressure cylinder 82 is full of working fluid F1. In step 1, pressure cylinder 82 is open to the evaporator 80 and the supply side of the liquid turbine 86, and it empties the working fluid F1 through the liquid turbine. As such, valve V1 is open ("1") and valve V2 closed ("0"), allowing the pressurizing fluid F2 to enter the pressure cylinder 82 from the evaporator 80. Valve V7 is open and valve V8 is closed, allowing the working fluid F1 to pass to the liquid turbine 86. During this step, pressure cylinder 83 is open to the return line from the liquid turbine 86 and is also open to the condenser 90. To achieve this, valve V10 and valve V4 are open, and valves V3 and V9 are closed. Working fluid F1 returning from the liquid turbine 86 therefore enters pressure cylinder 83. Pressurizing fluid F3/F4 is expelled from pressure cylinder 83 to the condenser 90. During step 1, the pressure cylinder 84 is inactive and sealed off from the evaporator 80 and both sides of the liquid turbine 86, and is only open to the condenser 90. As such, valve V6 is open and valves V5, V11 and V12 are closed. Valves V11 and V12 are closed to prevent pressure cylinder 84 filling.

When pressure cylinder 82 is empty, or substantially empty as sensed by a low level of working fluid F1 inside it, then this triggers the start of step 2, in the next column of TABLE 1. In step 2, pressure cylinder 83 is open to the evaporator 80 and the supply side of the liquid turbine 86, and it empties the working fluid F1 through the liquid turbine. As such, valve V3 is open and valve V4 is closed, allowing the pressurizing fluid F2 to enter the pressure cylinder 83 from the evaporator 80. Valve V9 is open and valve V10 is closed, allowing the working fluid F1 to pass to the liquid turbine 86. During this step, pressure cylinder 84 is open to the return line from the liquid turbine 86 and is also open to the condenser 90. To achieve this, valve V12 and valve V6 are open, and valves V5 and V11 are closed. Working fluid F1 returning from the liquid turbine 86 therefore enters pressure cylinder 84. Pressurizing fluid F3/F4 is expelled from pressure cylinder 84 to the condenser 90. During step 2, the pressure cylinder 82 is inactive and sealed off from the evaporator 80 and both sides of the liquid turbine 86, and is only open to the condenser 90. As such, valve V2 is open and valves V1, V7 and V8 are closed. Valves V7 and V8 are closed to prevent pressure cylinder 82 filling.

When pressure cylinder 83 is empty, or substantially empty as sensed by a low level of working fluid F1 inside it, then this triggers the start of step 3, in the next column of TABLE 1. In step 3, pressure cylinder 84 is open to the evaporator 80 and the supply side of the turbine 86, and it empties the working fluid F1 through the liquid turbine. As such, valve V5 is open and valve V6 is closed, allowing the pressurizing fluid F2 to enter the pressure cylinder 84 from the evaporator 80. Valve V11 is open and valve V12 is closed, allowing the working fluid F1 to pass to the liquid turbine 86. During this step, pressure cylinder 82 is open to the return line from the liquid turbine 86 and is also open to the condenser 90. To achieve this, valve V8 and valve V2 are open, and valves V7 and V1 are closed. Working fluid F1 returning from the liquid turbine 86 therefore enters pressure cylinder 82. Pressurizing fluid F3/F4 is expelled from pressure cylinder 82 to the condenser 90. During step 3, the pressure cylinder 83 is inactive and sealed off from the evaporator 80 and both sides of the liquid turbine 86, and is only open to the condenser 90. As such, valve V4 is open and valves V3, V9 and V10 are closed. Valves V9 and V10 are closed to prevent pressure cylinder 83 filling. When pressure cylinder 84 is empty, or substantially empty as sensed by a low level of working fluid F1 inside it, then this triggers the start of step 1 again.

The system is configured so that only one pressure cylinder is full of working fluid at a time. As this single pressure cylinder empties its working fluid, another single pressure cylinder refills, and all other pressure cylinders in the system remain filled with used pressurizing fluid. In other embodiments, the system is configured so that only one pressure cylinder is empty of working fluid at a time. For example, a single pressure cylinder empties its working fluid while another single pressure cylinder refills, while all other pressure cylinders in the system are already filled with working fluid. In other embodiments, other emptying and refilling control sequences may be employed.

In some embodiments of the system, the temperature of the working fluid F1 may always be above the boiling point of the pressurizing fluid, so that no condensation of the pressurizing fluid occurs in the pressure cylinders. In some embodiments, the working fluid is heated to the same temperature as the evaporator, or to the same temperature as the pressurizing fluid when it leaves the evaporator. In some embodiments, the surface of the working fluid may act as an evaporator acting on the pressurizing fluid.

Figure 6:
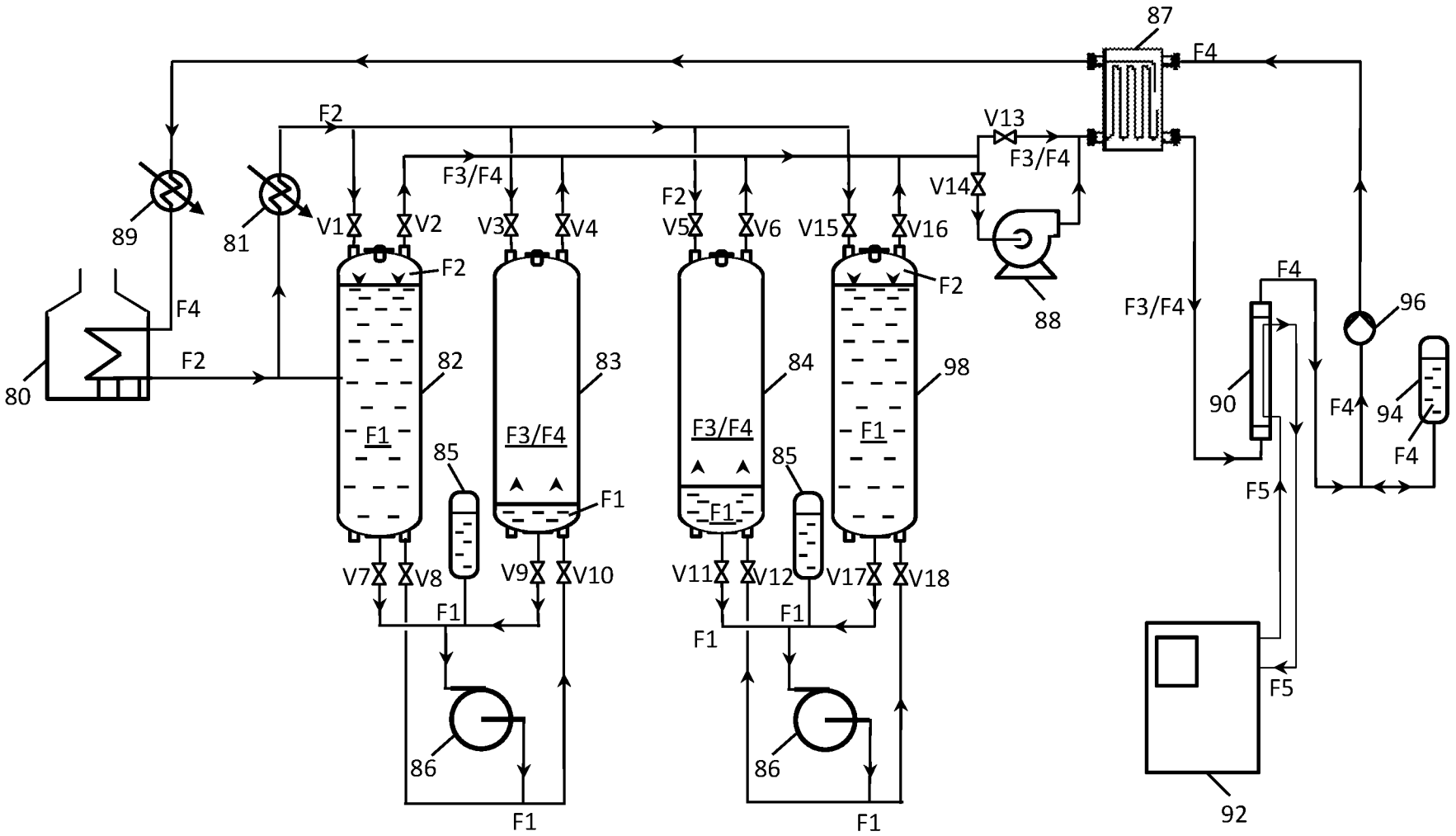
FIG. 6 is a system with four pressure cylinders and two turbines, according to an embodiment of the present invention.

FIG. 6 shows an example of a system layout with four pressure cylinders 82, 83, 84, 98 and two turbines 86. This is an alternate configuration that may be used to reduce deviations in the power output and increase the usefulness of the stroke. Many of the components are the same as in FIG. 5, with some of them being duplicated. The additional pressure cylinder 98 has an inlet valve V15 for pressurizing fluid F2 from the evaporator, and an outlet valve V16 to expel the spent pressurizing fluid F3/F4 to the condenser 90. At the bottom, pressure cylinder 98 has valve V17 through which the working fluid F1 is supplied to the liquid turbine 86, and a valve V18 for the return line from the liquid turbine.

This system runs with two groups of two pressure cylinders. One volume of working fluid F1 oscillates between the pressure cylinders 82 and 83, and another volume of working fluid oscillates between the pressure cylinders 84 and 98. Each pair of pressure cylinders drives a separate liquid turbine 86.

Different aspects of the system contribute to its efficiency and versatility. For example, the ability of the system to recycle the same volumes of working fluid and pressurizing fluid, rather than using one or other of the fluids in a single pass through the system, makes the process more efficient and environmentally friendly. The low pressure differential required to operate the system at meaningful efficiency allows for the system to run at lower temperatures when using volatile pressurizing fluids. The incoming vapor, i.e. the pressurizing fluid, loses energy to the working fluid in the pressure cylinders, making downstream condensing processes more efficient than if less energy were lost.

In general, a wide range of different heat sources may be used in the system. The main requirement is that the heat source be capable of boiling the pressurizing fluid. The heat source may be used in the evaporator 80 and the inline heaters 81, 89.

The use of a regenerator to recover thermal energy from the gaseous pressurizing fluid, after leaving the pressurizing cylinders, and return the energy to the system contributes to the efficiency of the system. The use of an MVR blower or compressor to recover thermal energy from the gaseous pressurizing fluid, after leaving the pressurizing cylinders, and return the energy to the system also contributes to the efficiency of the system.

Many different pressurizing fluids may be evaporated in the system to create the head pressure in the pressure cylinders, with minimal impact to the hardware requirements. In contrast, a gas turbine would require a redesign for each different gas used. This allows for a wide range of energy inputs and boiling temperatures to drive the system. In addition, the system may generate electricity from thermal energy sources using components that are a lower cost and easier to maintain than gas turbine systems of similar output.

The use of an inline heater to superheat the gaseous pressurizing fluid has the effect of increasing system efficiency, and can use recovered electrical energy generated by the liquid turbine in the case of load fluctuations. The use of an inline heater to superheat the liquid pressurizing fluid has the effect of increasing system efficiency, and can also use recovered electrical energy in the case of load fluctuations.

In some embodiments, the use of a diffusion condenser where the gaseous pressurizing fluid is diffused into cooled liquid pressurizing fluid allows for more efficient condensation.

The system allows for the use of liquid turbines, which are simpler to build and service compared to gas turbines, and are feasible at both small and large scales. Liquid turbines are also more efficient at lower temperatures and pressures, commonly operating at upwards of 90% efficiency, compared to below 25% for low-pressure gas turbines and below 65% efficiency for high-pressure gas turbines. Due to the low differential pressure requirement for a liquid turbine, the system allows for a wider range of thermal energy sources to be used.

A wide range of pressurizing fluids may be used in the system, so long as they have a boiling point lower than the temperature of the thermal energy source. This is an advantage over gas turbine systems. These characteristics give this system the potential to be used in remote areas where electricity is hard to come by, and to provide a renewable energy solution that works towards reversing global warming. The system has both a lower operating cost and capital cost than gas turbine systems of similar output.

Depending on the particular implementation of the system, one or more, but not necessarily all of the foregoing advantages described herein may be obtained.

Variations

Depending on the embodiment, the evaporator 80 may be any device used to boil or volatilize a fluid, including but not limited to: a falling film evaporator, a flash evaporator, a pot still, a wiped film evaporator, a fire tube boiler etc. There may be one or multiple evaporators depending on the embodiment. In some cases there may be no evaporator 80 if the pressurizing fluid is boiled entirely in the regenerator 87. As such, the term evaporator may mean a component other than evaporator 80, and the regenerator may therefore be referred to as an evaporator. The requirement is that the system has a means to evaporate the pressurizing fluid circulating within it.

Depending on the embodiment, the inline heaters 81, 89 may be electric immersion heaters or they may be inline heat exchangers heated by the main process heat or another heat source. There may be one or multiple inline heaters in series. The inline heaters are optional.

Depending on the embodiment, the regenerator 87 may be one of a wide number of different styles of heat exchanger including but not limited to: a shell and tube exchanger, a plate exchanger, a tube in tube exchanger etc. The regenerator is optional. There may be one or multiple regenerators.

While each of the heat sources has been described as being individually optional, at least one of the heat sources is required in the system in order to volatilize the pressurizing fluid.

The MVR blower 88 is optional. Depending on the embodiment, it may be one of a wide range of blower types including but not limited to: a regenerative blower, a side channel blower, a rotary vane compressor, a piston compressor, a rotary screw compressor etc. There may be one or multiple blowers.

Depending on the embodiment, the condenser 90 may be any device that can condense the gaseous pressurizing fluid, such as a wide number of different styles of heat exchanger including but not limited to: a shell and tube exchanger, a plate exchanger, a tube in tube exchanger etc. The system may function without a condenser 90 if the regenerator 87 can remove sufficient energy from the gaseous pressurizing fluid to condense enough for the system to cycle. In this case, the regenerator may be referred to as a condenser. In other embodiments, the system may function without a condenser 90 in the case where enough of the pressurizing fluid condenses during the expansion into the pressure cylinders 82. In other embodiments, the use of a condenser 90 may be avoided where complete condensation is achieved with the combination of the pressure cylinders 82 and the regenerator 87. In this case, the pressure cylinders and regenerator may be referred to as a condenser. The main requirement is that the system has a means for condensing the pressurizing fluid that is circulating within it. There may be one or multiple condensers. The condenser may be fed from the bottom and remain flooded as in the case of a diffusion condenser, or the gas may be condensed on a cold surface, as is common in a surface condenser.

Depending on the embodiment, the liquid pump 96 may be one or more of a wide number of different liquid pump types including but not limited to: a gear pump, a centrifugal pump, a diaphragm pump, a piston pump etc.

The buffer tank 94 may be of any volume and may be any vessel that can hold liquid. When necessary this is a pressure vessel. This buffer tank is optional.

The pressure cylinders 82, 83, 84, 98 may be the same size as each other or different sizes, depending on the embodiment. The pressure cylinders may have any number of valves, or shape of tank, provided that the headspace can be pressurized and the liquid working fluid can drain out of or be expelled from the tank. One or more pressure cylinders may be used as a buffer tank to smooth flow in the system by maintaining constant pressure. The pressure cylinders may be emptied in series intermittently. There may be as little as two pressure cylinders or as many as necessary to create even flow or to provide sufficient electricity or other power generation.

Depending on the embodiment, the liquid turbine 86 may be one of a wide number of different turbine types including but not limited to: a Francis turbine, a crossflow turbine, a Kaplan turbine etc. There may be one liquid turbine or multiple liquid turbines. There may be multiple stages to the liquid turbine. The liquid turbine may be coupled to an electric generator or to any other rotational equipment that receives torque to perform its functions or work. Multiple liquid turbines may be coupled to the same generator. In some embodiments, a flywheel may be coupled to the liquid turbine and flywheel to maintain momentum.

Depending on the embodiment, the chiller 92 may be any device that can cool down the condenser 90 enough to condense the gaseous pressurizing fluid. The chiller 90 may be a wide number of different chiller types, including but not limited to: a dry fluid cooler, an electric refrigerant-based chiller, an evaporative cooler, a wet surface evaporator etc. In some embodiments, the chiller 90 may be a cold fluid stream from another source, for example cold water from a water source.

Depending on the embodiment, the pressure buffer tank 85 may be any vessel that can hold a liquid and a gas. This pressure buffer tank may be kept pressurized by a gas head in the top of the tank, and this pressurized gas head may in turn be pressurized by another pressurized gas tank. The pressure buffer tank 85 may have a bladder or diaphragm in it to separate the liquid from the gas. A piston with a spring may be used instead of a gas pressure head. The pressure buffer tank 85 is optional, and there could be one or many. In some cases the working fluid enters the pressure buffer tank through the same port from which the working fluid exits the pressure buffer tank. The buffer tank 85 may often be larger than the volume of one or all of the pressure cylinders but may also be smaller.

In other embodiments, more pressure cylinders may be added to the system, in tandem, parallel or series. The system may be increased in size by adding more, duplicate components, allowing it to be scaled without significant redesign.

Several different mechanisms may be used for controlling the valves. For example, pneumatic valves may could be controlled by a PLC (programmable logic controller), or a mechanical system may actuate the valves based on the position of a mechanical assembly, as is customary in reciprocating piston engines. Any mechanism that can open and close valves may be used. The valves may be any type of valve, including but not limited to: one way check valves, angle seat valves, gate valves, globe valves, etc. Valves may be any size. There may be more valves added to improve the functionality of the system, for example pressure regulating valves, needle valves, additional shutoff valves or drainage valves.

Sensors may be placed differently, and different trigger points may be used for the switching of valves. For example, each cycle of the system may be triggered by detecting a high level of working fluid in the pressure cylinders rather than a low level.

In some embodiments, energy is taken from temperatures at ambient or below ambient. For example, the waste heat generated by air-conditioning processes may be used in the system to heat the pressurizing fluid, and in turn contribute to the generation of electricity.

In some embodiments, the system condenses water out of the air or from an industrial process, and uses the energy from the condensation to produce electricity. This allows for dehumidification processes to produce electricity.

In some embodiments, the condenser 90 may be a diffusion condenser, as described in U.S. Pat. No. 11,067,339. In this type of condenser, the gaseous pressurizing fluid is diffused into cooled liquid pressurizing fluid, allowing for efficient condensation.

The system may use waste heat from a wide range of sources because of its temperature range capacity. For example, such sources may be composting agricultural waste, geothermal, industrial process waste heat, waste heat from computing or cryptocurrency mining or any other source of thermal energy. In some embodiments, solar energy is used.

In order to handle fluctuations in the demand of electricity from the grid, this system can use electric heaters to recycle energy back into the system.

In some embodiments, the working fluid is not cycled between the pressure cylinders, but is instead expelled from the system after a single stroke. An example of this would be if the system were set up to use a continuous waste water stream. In this system, the pressure cylinders fill with the waste water, which is used a single time as the working fluid, passing through the turbine only once, and then the working fluid is expelled to waste.

In general, unless otherwise indicated, singular elements may be in the plural and vice versa with no loss of generality. Throughout the description, specific details have been set forth in order to provide a more thorough understanding of the invention. However, the invention may be practiced without these particulars. In other instances, well known elements have not been shown or described in detail and repetitions of steps and features have been omitted to avoid unnecessarily obscuring the invention. As such, the specification is to be regarded in an illustrative, rather than a restrictive, sense. It will be clear to one having skill in the art that further variations to the specific details disclosed herein can be made, resulting in other embodiments that are within the scope of the invention disclosed. Accordingly, the scope of the invention is to be construed in accordance with the substance defined by the following claims.

The invention claimed is:

1. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine; and multiple valves that are operable to:

(a) admit a volume of the pressurizing fluid, when gaseous, from the evaporator into a first one of the pressure cylinders in order to transfer a liquid working fluid therefrom to the liquid turbine, wherein the pressurizing fluid has a lower boiling point than the liquid working fluid; and (b) admit the liquid working fluid from the liquid turbine into a second one of the pressurizing cylinders in order to transfer another volume of the pressurizing fluid therefrom to the condenser.

2. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine; and multiple valves that are operable to:

(a) admit a volume of the pressurizing fluid, when gaseous, from the evaporator into a first one of the pressure cylinders in order to transfer a liquid working fluid therefrom to the liquid turbine, wherein the pressurizing fluid and the liquid working fluid are immiscible with each other; and (b) admit the liquid working fluid from the liquid turbine into a second one of the pressurizing cylinders in order to transfer another volume of the pressurizing fluid therefrom to the condenser.

3. The power generation system of claim 1, further comprising the pressurizing fluid and the liquid working fluid.

4. The power generation system of claim 1, wherein:

the liquid working fluid is water and the pressurizing fluid is hexane, pentane or butane; or the pressurizing fluid is water and the liquid working fluid is oil or mercury.

5. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine;

an inline heater between the evaporator and the pressure cylinders; and multiple valves that are operable to:

(a) admit a volume of the pressurizing fluid, when gaseous, from the evaporator into a first one of the pressure cylinders in order to transfer a liquid working fluid therefrom to the liquid turbine; and (b) admit the liquid working fluid from the liquid turbine into a second one of the pressurizing cylinders in order to transfer another volume of the pressurizing fluid therefrom to the condenser.

6. The power generation system of claim 1, further comprising an inline heater that heats the pressurizing fluid before it enters the evaporator.

7. The power generation system of claim 1, further comprising a chiller that cools the condenser.

8. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine;

multiple valves that are operable to:

(a) admit a volume of the pressurizing fluid, when gaseous, from the evaporator into a first one of the pressure cylinders in order to transfer a liquid working fluid therefrom to the liquid turbine; and (b) admit the liquid working fluid from the liquid turbine into a second one of the pressurizing cylinders in order to transfer another volume of the pressurizing fluid therefrom to the condenser; and a regenerator that:

cools the pressurizing fluid after it leaves the pressure cylinders; and heats the pressurizing fluid, in the liquid state, after it leaves the condenser.

9. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine; and multiple valves that are operable to:

(a) admit a volume of the pressurizing fluid, when gaseous, from the evaporator into a first one of the pressure cylinders in order to transfer a liquid working fluid therefrom to the liquid turbine; and (b) admit the liquid working fluid from the liquid turbine into a second one of the pressurizing cylinders in order to transfer another volume of the pressurizing fluid therefrom to the condenser; and a mechanical vapor recompression blower that compresses the pressurizing fluid after it leaves the pressure cylinders.

10. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine; and multiple valves that are operable to:

(a) admit a volume of the pressurizing fluid, when gaseous, from the evaporator into a first one of the pressure cylinders in order to transfer a liquid working fluid therefrom to the liquid turbine; and (b) admit the liquid working fluid from the liquid turbine into a second one of the pressurizing cylinders in order to transfer another volume of the pressurizing fluid therefrom to the condenser; and a buffer tank connected to hold a further volume of the pressurizing fluid in the liquid state so that the liquid pump is not starved of the pressurizing fluid in the liquid state.

11. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine; and multiple valves that are operable to:

(a) admit a volume of the pressurizing fluid, when gaseous, from the evaporator into a first one of the pressure cylinders in order to transfer a liquid working fluid therefrom to the liquid turbine; and (b) admit the liquid working fluid from the liquid turbine into a second one of the pressurizing cylinders in order to transfer another volume of the pressurizing fluid therefrom to the condenser; and another liquid turbine connected to be driven by the liquid working fluid when the liquid working fluid is expelled from a third one of the pressure cylinders.

12. A power generation system comprising:

an evaporator;

a condenser;

a liquid pump connected to pump pressurizing fluid, in a liquid state, from the condenser to the evaporator;

a liquid turbine;

multiple pressure cylinders, each with an inlet from the evaporator, an outlet to the condenser, an outlet to the liquid turbine and an inlet from the liquid turbine; and multiple valves that are operable to:

(a) admit a volume of the pressurizing fluid, when gaseous, from the evaporator into a first one of the pressure cylinders in order to transfer a liquid working fluid therefrom to the liquid turbine; and (b) admit the liquid working fluid from the liquid turbine into a second one of the pressurizing cylinders in order to transfer another volume of the pressurizing fluid therefrom to the condenser; and a buffer tank connected to hold a volume of the liquid working fluid between the pressure cylinders and the liquid turbine.

13. The power generation system of claim 1, further comprising a generator connected to be driven by the liquid turbine.

14. The power generation system of claim 13, configured to use electricity produced by the generator.

15. The power generation system of claim 1, wherein the condenser is a diffusion condenser.

16. A method for driving a liquid turbine comprising:

(a) using a liquid pump to pump a pressurizing fluid, in a liquid state, from a condenser to an evaporator;

(b) evaporating the pressurizing fluid using the evaporator;

(c) admitting a volume of the pressurizing fluid from the evaporator into a first pressure cylinder in order to transfer a liquid working fluid therefrom to a liquid turbine;

(d) admitting the liquid working fluid from the liquid turbine into a second pressure cylinder in order to transfer another volume of the pressurizing fluid therefrom to the condenser; and (e) maintaining a temperature of the liquid working fluid above a boiling point of the pressurizing fluid.

17. The method of claim 16 further comprising:

repeating (c) for the second pressure cylinder; and repeating (d) for the first pressure cylinder or a third pressure cylinder.

18. The power generation system of claim 1, wherein the multiple valves are further operable to:

repeat (a) for the second one of the pressure cylinders; and repeat (b) for the first one of the pressure cylinders or a third one of the pressure cylinders.

19. The power generation system of claim 2, wherein the multiple valves are further operable to:

repeat (a) for the second one of the pressure cylinders; and repeat (b) for the first one of the pressure cylinders or a third one of the pressure cylinders.

20. The power generation system of claim 2, further comprising the pressurizing fluid and the liquid working fluid.

21. The power generation system of claim 2, wherein:

the liquid working fluid is water and the pressurizing fluid is hexane, pentane or butane; or the pressurizing fluid is water and the liquid working fluid is oil or mercury.

22. The power generation system of claim 2, further comprising an inline heater that heats the pressurizing fluid before it enters the evaporator.

23. The power generation system of claim 2, further comprising a chiller that cools the condenser.

24. The power generation system of claim 2, further comprising a generator connected to be driven by the liquid turbine.

25. The power generation system of claim 24, configured to use electricity produced by the generator.

26. The power generation system of claim 2, wherein the condenser is a diffusion condenser.

27. The power generation system of claim 5, wherein the multiple valves are further operable to:

repeat (a) for the second one of the pressure cylinders; and repeat (b) for the first one of the pressure cylinders or a third one of the pressure cylinders.

28. The power generation system of claim 5, further comprising the pressurizing fluid and the liquid working fluid.

29. The power generation system of claim 5, wherein:

the liquid working fluid is water and the pressurizing fluid is hexane, pentane or butane; or the pressurizing fluid is water and the liquid working fluid is oil or mercury.

30. The power generation system of claim 5, further comprising another inline heater that heats the pressurizing fluid before it enters the evaporator.

31. The power generation system of claim 5, further comprising a chiller that cools the condenser.

32. The power generation system of claim 5, further comprising a generator connected to be driven by the liquid turbine.

33. The power generation system of claim 32, configured to use electricity produced by the generator.

34. The power generation system of claim 5, wherein the condenser is a diffusion condenser.

35. The power generation system of claim 8, wherein the multiple valves are further operable to:

repeat (a) for the second one of the pressure cylinders; and repeat (b) for the first one of the pressure cylinders or a third one of the pressure cylinders.

36. The power generation system of claim 8, further comprising the pressurizing fluid and the liquid working fluid.

37. The power generation system of claim 8, wherein:

the liquid working fluid is water and the pressurizing fluid is hexane, pentane or butane; or the pressurizing fluid is water and the liquid working fluid is oil or mercury.

38. The power generation system of claim 8, further comprising an inline heater that heats the pressurizing fluid before it enters the evaporator.

39. The power generation system of claim 8, further comprising a chiller that cools the condenser.

40. The power generation system of claim 8, further comprising a generator connected to be driven by the liquid turbine.

41. The power generation system of claim 40, configured to use electricity produced by the generator.

42. The power generation system of claim 8, wherein the condenser is a diffusion condenser.

43. The power generation system of claim 9, wherein the multiple valves are further operable to:

repeat (a) for the second one of the pressure cylinders; and repeat (b) for the first one of the pressure cylinders or a third one of the pressure cylinders.

44. The power generation system of claim 9, further comprising the pressurizing fluid and the liquid working fluid.

45. The power generation system of claim 9, wherein:

the liquid working fluid is water and the pressurizing fluid is hexane, pentane or butane; or the pressurizing fluid is water and the liquid working fluid is oil or mercury.

46. The power generation system of claim 9, further comprising an inline heater that heats the pressurizing fluid before it enters the evaporator.

47. The power generation system of claim 9, further comprising a chiller that cools the condenser.

48. The power generation system of claim 9, further comprising a generator connected to be driven by the liquid turbine.

49. The power generation system of claim 48, configured to use electricity produced by the generator.

50. The power generation system of claim 9, wherein the condenser is a diffusion condenser.

51. The power generation system of claim 10, wherein the multiple valves are further operable to:

repeat (a) for the second one of the pressure cylinders; and repeat (b) for the first one of the pressure cylinders or a third one of the pressure cylinders.

52. The power generation system of claim 10, further comprising the pressurizing fluid and the liquid working fluid.

53. The power generation system of claim 10, wherein:

the liquid working fluid is water and the pressurizing fluid is hexane, pentane or butane; or the pressurizing fluid is water and the liquid working fluid is oil or mercury.

54. The power generation system of claim 10, further comprising an inline heater that heats the pressurizing fluid before it enters the evaporator.

55. The power generation system of claim 10, further comprising a chiller that cools the condenser.

56. The power generation system of claim 10, further comprising a generator connected to be driven by the liquid turbine.

57. The power generation system of claim 56, configured to use electricity produced by the generator.

58. The power generation system of claim 10, wherein the condenser is a diffusion condenser.

59. The power generation system of claim 11, wherein the multiple valves are further operable to:

repeat (a) for the second one of the pressure cylinders; and repeat (b) for the first one of the pressure cylinders or a third one of the pressure cylinders.

60. The power generation system of claim 11, further comprising the pressurizing fluid and the liquid working fluid.

61. The power generation system of claim 11, wherein:

the liquid working fluid is water and the pressurizing fluid is hexane, pentane or butane; or the pressurizing fluid is water and the liquid working fluid is oil or mercury.

62. The power generation system of claim 11, further comprising an inline heater that heats the pressurizing fluid before it enters the evaporator.

63. The power generation system of claim 11, further comprising a chiller that cools the condenser.

64. The power generation system of claim 11, further comprising a generator connected to be driven by the liquid turbine.

65. The power generation system of claim 64, configured to use electricity produced by the generator.

66. The power generation system of claim 11, wherein the condenser is a diffusion condenser.

67. The power generation system of claim 12, wherein the multiple valves are further operable to:

repeat (a) for the second one of the pressure cylinders; and repeat (b) for the first one of the pressure cylinders or a third one of the pressure cylinders.

68. The power generation system of claim 12, further comprising the pressurizing fluid and the liquid working fluid.

69. The power generation system of claim 12, wherein:

the liquid working fluid is water and the pressurizing fluid is hexane, pentane or butane; or the pressurizing fluid is water and the liquid working fluid is oil or mercury.

70. The power generation system of claim 12, further comprising an inline heater that heats the pressurizing fluid before it enters the evaporator.

71. The power generation system of claim 12, further comprising a chiller that cools the condenser.

72. The power generation system of claim 12, further comprising a generator connected to be driven by the liquid turbine.

73. The power generation system of claim 72, configured to use electricity produced by the generator.

74. The power generation system of claim 12, wherein the condenser is a diffusion condenser.

* * * * *